US006227957B1

(12) United States Patent
Legatt et al.

(10) Patent No.: US 6,227,957 B1
(45) **Date of Patent: *May 8, 2001**

(54) BATTERY POWERED, RIDING, FLOOR BURNISHING MACHINE

(75) Inventors: Donald Joseph Legatt, St. Michael; Kipp W. Knutson, Shorewood, both of MN (US)

(73) Assignee: Nilfisk-Advance, Inc., Plymouth, MN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/083,900

(22) Filed: May 22, 1998

(51) Int. Cl.[7] ..... A47L 11/14
(52) U.S. Cl. ..... 451/350; 451/353
(58) Field of Search ..... 451/350, 353

(56) References Cited

U.S. PATENT DOCUMENTS

| | | | | |
|---|---|---|---|---|
| 446,817 | * | 2/1891 | Hunter | 105/51 |
| 667,189 | * | 2/1901 | Condict | 180/65 R |
| 2,387,077 | | 10/1945 | Johnson | 280/32 |
| 2,898,826 | | 8/1959 | Livermont | 94/45 |
| 3,198,030 | | 8/1965 | Miller et al. | 74/493 |
| 3,362,247 | | 1/1968 | Watts | 74/493 |
| 3,424,964 | | 1/1969 | Bacon | 318/220 |
| 3,426,259 | | 2/1969 | Ziehm | 318/102 |
| 3,556,549 | | 1/1971 | Hershman et al. | 280/87 |
| 3,599,006 | | 8/1971 | Harris | 307/39 |
| 3,668,485 | | 6/1972 | Norris | 318/12 |
| 3,784,846 | | 1/1974 | Krick et al. | 307/293 |
| 3,875,487 | | 4/1975 | White | 318/485 |
| 3,983,952 | * | 10/1976 | McKee | 180/65 R |
| 4,023,434 | | 5/1977 | Axelsson | 74/496 |

(List continued on next page.)

OTHER PUBLICATIONS

M2700–ABS Automatic Burnishing System, Minuteman International, Illinois, Oct. 1997, 986740–20N.

*Primary Examiner*—Allen Ostrager
*Assistant Examiner*—William Hong
(74) *Attorney, Agent, or Firm*—Alan Kamrath; Rider Bennett Egan & Arundel, LLP.

(57) ABSTRACT

A riding burnishing machine (10) includes a battery pack positioned as low as possible in the chassis (12) between the front and rear wheels (14, 15) and removable in a horizontal movement direction while supported by the bottom by a pallet jack. A steering system includes steering shafts (58, 76) which are rotatable together while allowing relative pivotable movement therebetween and which are rotatably connected to the spindle (38) of the steerable rear wheels (15) through a jack shaft (44). The burnishing head is raised and lowered relative to the floor surface by an electric actuator (104) which pivots a linkage (92) through a connection allowing floating travel. The pressure which the treating member (16) engages the floor surface is controlled in response to the current level of the electric motor (86) which rotates the treating member (16). The current level of the electric motor (86) is measured by monitoring the voltage at the ends of a negative supply lead cable (144) and the temperature of the cable (144).

18 Claims, 3 Drawing Sheets

U.S. PATENT DOCUMENTS

| | | | | |
|---|---|---|---|---|
| 4,100,466 | | 7/1978 | Schroeder | 318/102 |
| 4,158,901 | | 6/1979 | Wulff et al. | 15/401 |
| 4,196,462 | | 4/1980 | Pohl | 361/33 |
| 4,216,839 | * | 8/1980 | Gould et al. | 180/65 R |
| 4,392,670 | | 7/1983 | Schultz | 280/775 |
| 4,443,906 | | 4/1984 | Tucker et al. | 15/50 |
| 4,506,405 | | 3/1985 | Block | 15/320 |
| 4,590,635 | | 5/1986 | Tucker et al. | 15/50 |
| 4,633,541 | | 1/1987 | Block | 15/49 |
| 4,652,802 | | 3/1987 | Johnston | 318/482 |
| 4,654,918 | | 4/1987 | Cooper | 15/98 |
| 4,667,364 | | 5/1987 | Meili | 15/320 |
| 4,674,142 | | 6/1987 | Meili | 15/49 |
| 4,675,935 | | 6/1987 | Kasper et al. | 15/319 |
| 4,679,271 | | 7/1987 | Field et al. | 15/49 |
| 4,729,141 | | 3/1988 | Berg et al. | 15/49 |
| 4,736,116 | | 4/1988 | Pavlak, Jr. et al. | 307/41 |
| 4,757,566 | | 7/1988 | Field et al. | 15/49 |
| 4,787,646 | | 11/1988 | Kamlukin et al. | 280/95 |
| 4,825,500 | | 5/1989 | Basham et al. | 15/319 |
| 4,879,623 | | 11/1989 | Baumgartner et al. | 361/33 |
| 4,906,857 | | 3/1990 | Cummins et al. | 290/38 |
| 4,967,864 | * | 11/1990 | Boyer et al. | 180/65.1 |
| 5,016,722 | | 5/1991 | Morita et al. | 180/89.14 |
| 5,177,828 | | 1/1993 | Von Vett | 15/98 |
| 5,208,521 | | 5/1993 | Aoyama | 318/587 |
| 5,279,672 | | 1/1994 | Betker et al. | 134/18 |
| 5,298,080 | | 3/1994 | Von Vett | 134/18 |
| 5,355,059 | | 10/1994 | McMillan | 318/103 |
| 5,448,442 | | 9/1995 | Farag | 361/24 |
| 5,522,734 | * | 6/1996 | Goertzen | 439/500 |
| 5,534,364 | * | 7/1996 | Watanabe et al. | 429/61 |
| 5,605,493 | * | 2/1997 | Donatelli et al. | 451/41 |
| 5,698,957 | | 12/1997 | Sowada | 318/434 |
| 5,890,545 | * | 4/1999 | Smith et al. | 172/200 |

* cited by examiner

BATTERY POWERED, RIDING, FLOOR BURNISHING MACHINE

BACKGROUND

The present invention relates to apparatus for treating surfaces, particularly to apparatus for polishing floor surfaces, and specifically to unique and novel floor burnishing machines.

A popular method of creating a "gloss" shine on finished tile flooring is after wet-scrubbing the floor, burnishing the floor with a machine that has a disc-shaped polishing pad rotated at a high RPM. The polishing pad removes any small imperfections and scuff marks in the finish, giving the floor a "wet-look" gloss. An added benefit of burnishing is that the finish becomes "work-hardened", which results in a more durable, usable surface.

Current burnishing machines are made in three different powered configurations: cord powered through wall outlets, battery powered through deep cycle batteries carried on board, and internal combustion (IC) powered using propane fuel rather than gasoline. Each type of machine has it's own unique market. Cord machines are used in confined areas. Since the available power is rather limited, cord machines produce the least gloss rise of the three categories. Battery powered machines are used where areas are larger, emission requirements are more rigid, and higher gloss is required in comparison to a cord machine. The available power is greater than the cord machine, but the machine weight is greater due to the batteries on board, and the run time to discharge the batteries is a limiting factor for productivity. The walk-behind propane machines have the greatest power available due to the IC engine, the run time is unlimited due to the replaceable propane tanks, and the resulting performance is the greatest of the three machines. Because of the greater performance, the propane machine is usually operated at a higher rate of travel speed than the other machines, which results in a higher productivity rate.

The propane machine is therefore the machine of choice for many contract cleaners and retail stores for it's high gloss shine and high productivity. The one major drawback, however, is that the machine, due to it's IC engine running in a confined building, creates potentially hazardous emissions in the air.

Recognizing the safety hazard associated with internal combustion engine powered machines, a need exists for a battery operated machine which equals the propane machine in gloss performance, as well as providing higher productivity, all without the emissions hazards. Also, it is desirable that the operator rides on the machine so that the battery operated burnishing machine can travel faster than a walk-behind propane machine, and the operator will not tire during extended operating periods.

SUMMARY

The present invention solves these needs and other problems in the field of surface treating apparatus by providing, in the preferred form, a battery box mounted in the chassis as low as possible with the bottom of the battery box defining a space with the surface which is free of obstruction so that the center of gravity is lowered and the stability of the apparatus is increased.

In another aspect of the present invention, a battery box for holding the apparatus batteries can be removed and inserted into the apparatus chassis in a horizontal movement direction while supported by the bottom of the battery box, with the battery box in the most preferred form being prevented from moving in the horizontal movement direction in a lowered position while being allowed to move in the horizontal movement direction in a raised position.

In other aspects of the present invention, a steering column is pivotably connected to a pillar of the chassis of a surface treating apparatus and rotatably mounts an upper steering shaft which is rotatably and pivotably connected to a lower steering shaft rotatably mounted in the pillar, with the rear wheels of the surface treating apparatus being rotatably connected to the lower steering shaft for being turned by the manual rotation of the upper steering shaft. In the most preferred form, the steering column can be locked in one of a plurality of pivotable positions relative to the pillar.

In still other aspects of the present invention, the surface treating member is raised, lowered, and allowed to float relative to the surface by providing a housing which is restrained on a nut threadable on the rotatable threaded shaft of an actuator but which is allowed axial movement relative to the nut for a distance while being biased away from the nut, with the housing being pivotably mounted to a linkage pivotably mounted to the apparatus chassis and the surface treating member and with the actuator being pivotably mounted to the apparatus chassis.

In further aspects of the present invention, the pressure which a treating member engages the surface is controlled in response to the current level of the electric motor which rotates the treating member, with the treating member being moved towards the surface if the current level is below a predetermined range and being moved away from the surface if the current level is above a predetermined range.

In most preferred aspects of the present invention, the current of an electrical device and particularly the electric motor which rotates the surface treating member is measured by monitoring the voltage at the ends of the negative supply lead cable (and in the most preferred form the temperature of the cable) rather than a conventional shunt in series with the electrical device.

It is thus an object of the present invention to provide a novel apparatus for treating surfaces.

It is further an object of the present invention to provide such a novel surface treating apparatus having extended operation without potentially hazardous emissions.

It is further an object of the present invention to provide such a novel surface treating apparatus having easily interchangeable battery packs for extended operation.

It is further an object of the present invention to provide such a novel surface treating apparatus upon which the operator rides.

It is further an object of the present invention to provide such a novel surface treating apparatus which travels faster than conventional walk-behind apparatus.

It is further an object of the present invention to provide such a novel surface treating apparatus which is battery operated but provides burnishing performance equaling that of propane powered apparatus.

It is further an object of the present invention to provide such a novel surface treating apparatus providing higher productivity.

It is further an object of the present invention to provide such a novel surface treating apparatus having a unique floating linkage for the operating head.

It is further an object of the present invention to provide such a novel surface treating apparatus having a treating member engaging the surface responsive to the current level of the electric motor which rotates the treating member.

It is further an object of the present invention to provide such a novel surface treating apparatus which monitors the current level through the electric motor by monitoring the voltage drop through the negative supply lead cable and without a conventional shunt.

These and further objects and advantages of the present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
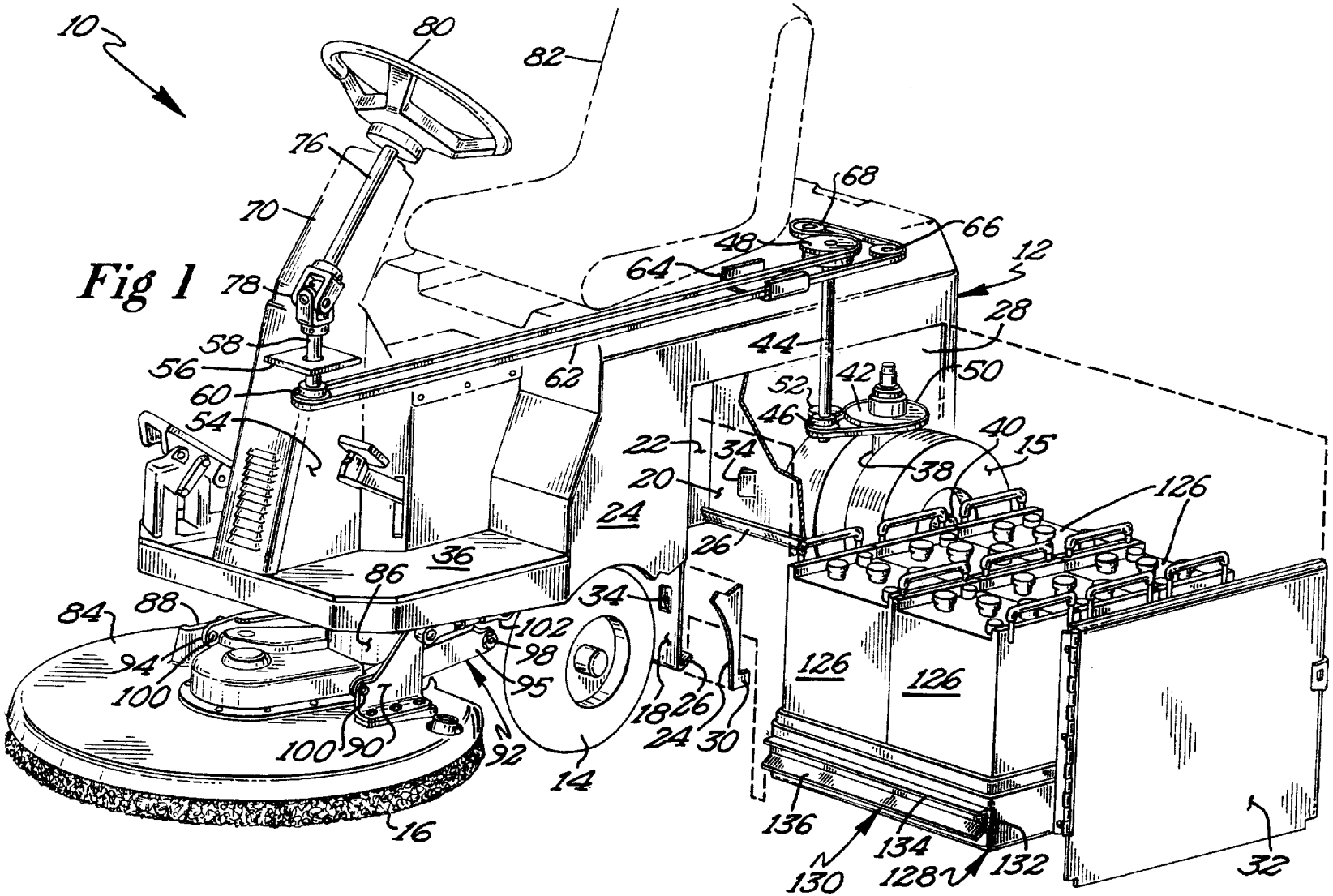
FIG. 1 shows an exploded, top perspective view of a floor polishing machine according to the preferred teachings of the present invention, with portions shown in phantom to show internal constructional details.
Figure 2:
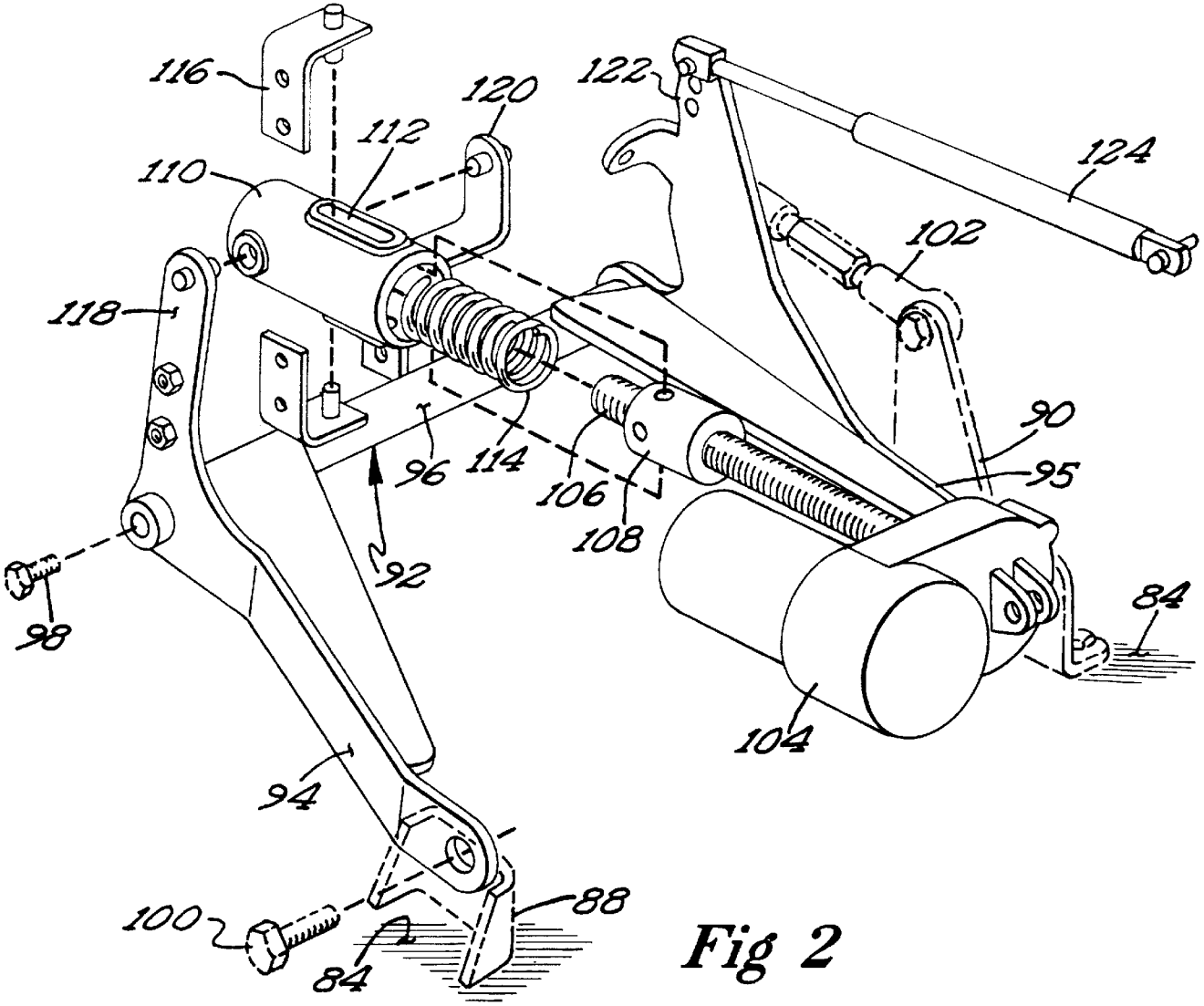
FIG. 2 shows a partial, perspective view of the surface treating member raising and lowering apparatus of the floor polishing machine of FIG. 1, with portions broken away and shown in phantom.
Figure 3:
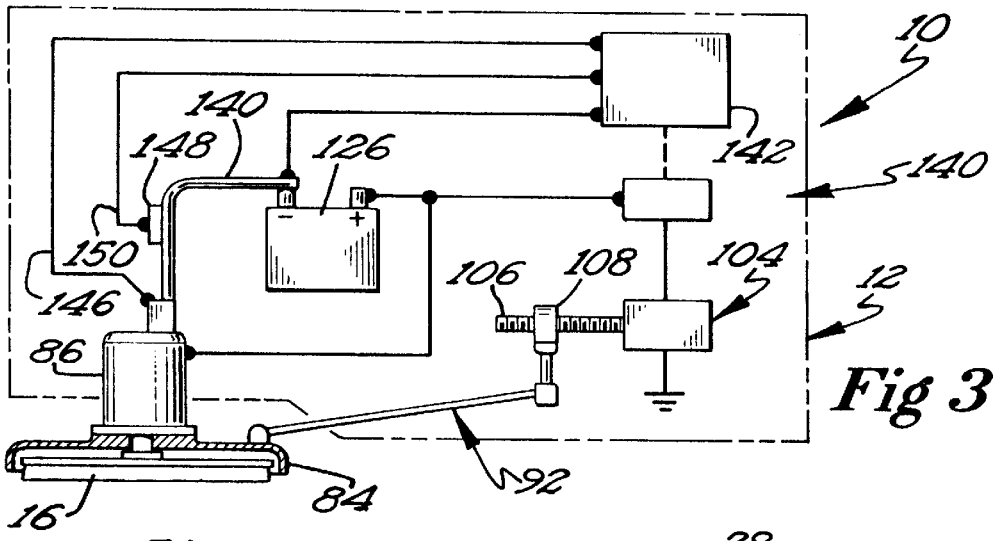
FIG. 3 shows a diagrammatic view of the electronic control system of the floor polishing machine of FIG. 1.
Figure 4:
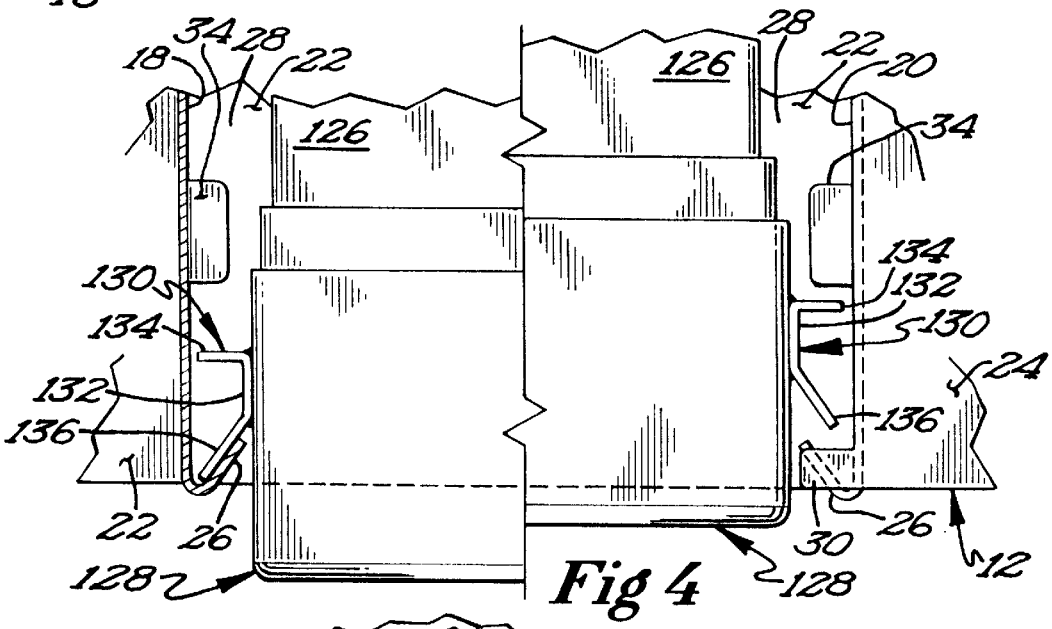
FIG. 4 shows an enlarged, partial, cross-sectional view of the interlock between the chassis and the battery pack of the floor polishing machine of FIG. 1 and broken to illustrate both raised and lowered positions.
Figure 5:
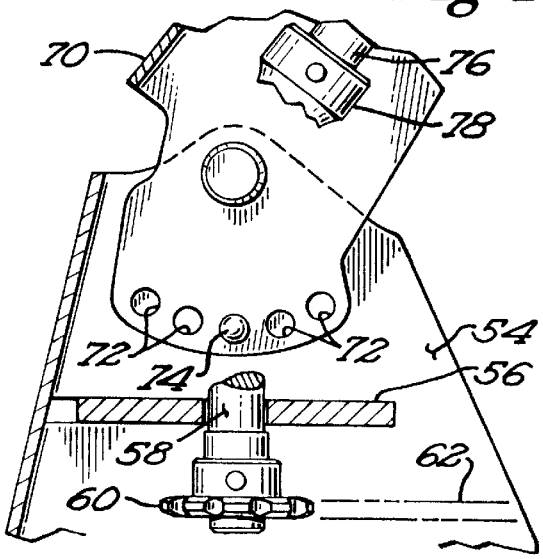
FIG. 5 shows an enlarged partial, perspective view, partially in section, of the steering system of the floor polishing machine of FIG. 1.

All figures are drawn for ease of explanation of the basic teachings of the preferred embodiment only; the extensions of the Figures with respect to number, position, relationship, and dimensions of the parts to form the preferred embodiment will be explained or will be within the skill of the art after the following description has been read and understood. Further, the exact dimensions and dimensional proportions to conform to specific force, weight, strength, and similar requirements will likewise be within the skill of the art after the following description has been read and understood.

Where used in the various figures of the drawings, the same numerals designate the same or similar parts. Furthermore, when the terms "top", "bottom", "upper", "lower", "first", "second", "front", "rear", "end", "edge", "forward", "rearward", "inside", "side", "longitudinal", "lateral", "horizontal", "vertical", and similar terms are used herein, it should be understood that these terms have reference only to the structure shown in the drawings as it would appear to a person viewing the drawings and are utilized only to facilitate describing the preferred embodiment.

DESCRIPTION

A machine for treating or maintaining a work surface is shown in the drawings in its preferred form as a floor polishing machine and in its most preferred form as a burnishing machine according to the preferred teachings of the present invention and is generally designated 10. Floor polishing machine 10 generally includes a chassis or body portion 12 adapted to be moved along a floor or other cleaning surface such as by wheels 14 and 15. A planar polishing member 16 for polishing the floor surface when rotated about a polishing axis extending generally perpendicular to the floor and in a plane substantially parallel to the floor surface when body portion 12 is moved along the floor on wheels 14 and 15 is provided in its most preferred form as a holder of the flexible type for a polishing pad, brush or the like. In the preferred form, polishing member 16 is positioned adjacent to the front of chassis 12 and generally in front of wheels 14 and in particular generally on the opposite side of wheels 14 than wheels 15.

Chassis 12 generally includes a battery compartment formed and defined by spaced, parallel front and rear walls 18 and 20 extending generally laterally of chassis 12 and generally perpendicular to the forward movement direction of machine 10. The battery compartment is further defined by spaced, parallel right and left side walls 22 and 24 extending generally longitudinally of chassis 12, generally perpendicular to walls 18 and 20, and generally parallel to the forward movement direction of machine 10. In its most preferred form, the bottom of the battery compartment defined by the lower edges of walls 18, 20, 22, and 24 is open, with the lower edges of walls 18 and 20 terminating in upwardly and inwardly extending flanges 26 extending at an acute angle in the order of 45°. Left side wall 24 includes an opening 28 having end edges generally corresponding to walls 18 and 20 but having rectangular projections 30 having a vertical height and horizontal width generally equal to the horizontal and vertical extent of the free edges of flanges 26. Chassis 12 in the most preferred form includes a door 32 for closing opening 28 which in the preferred form is hingedly connected along the front end edge of opening 28 of side wall 24. Walls 18 and 20 each further include first and second tabs 34 bent inwardly adjacent to their side edges and spaced vertically above the vertical extent of flanges 26 and projections 30. Chassis 12 further includes a generally horizontal platform 36 located forwardly of front wall 18.

Wheels 14 are mounted adjacent to the front of chassis 12 and located forward of but closely adjacent front wall 18, generally below platform 36 and inwardly of side walls 22 and 24. In the preferred form, wheels 14 are driven by any suitable means, not shown, and can include suitable provisions allowing for differential movement between wheels 14.

In the preferred form, a spindle 38 is suitably rotatably mounted to chassis 12 about a vertical axis located rearwardly of rear wall 20 and adjacent to the rear of chassis 12. First and second axles 40 extend generally perpendicular from opposite sides of spindle 38 adjacent to its lower end. Wheels 15 are suitably rotatably mounted to axles 40 on opposite sides of and closely adjacent to spindle 38, with wheels 15 being steerable and located adjacent to the rear of chassis 12. It can then be appreciated that wheels 14 and 15 form a tricycle wheel arrangement. Although in the preferred form dual wheels 15 are provided and are believed to be advantageous at least in the reduction of surface scuffing, in the reduction of steering effort, and in the ability to run over obstructions on the floor surface, a single wheel 15 could be provided according to the teachings of the present invention and would be otherwise advantageous such as in reduction of the rear dimension of machine 10.

In the preferred form, machine 10 is steered by the rotation of spindle 38 about its vertical axis. Specifically, in the preferred form, a sprocket 42 is suitably secured to spindle 38. A jack shaft 44 is suitably rotatably mounted to chassis 12 about a vertical axis spaced and parallel to the vertical axis of spindle 38 and located rearwardly of rear wall 20 and adjacent the rear of chassis 12. Lower and upper sprockets 46 and 48 are suitably secured to the opposite ends of jack shaft 44. Spindle 38 and jack shaft 44 are suitably connected together for rotation together such as by an endless flaccid member in the preferred form of a roller chain 50 extending around and between sprockets 42 and 46. In the most preferred form, an idler sprocket 52 is provided for engaging roller chain 50 between sprockets 42 and 46.

The steering system of machine 10 according to the preferred teachings of the present invention further includes a pillar formed on chassis 12 in the preferred form by at least first and second vertical plates 54 upstanding from the front of platform 36 and adjacent to the front of chassis 12. The pillar further has a generally horizontal plate 56 extending between plates 54 intermediate their upper and lower ends. A lower steering shaft 58 is suitably rotatably mounted to plate 56 of chassis 12 about a vertical axis spaced and parallel to the vertical axes of spindle 38 and jack shaft 44 and located forward of front wall 18. A sprocket 60 is suitably secured to the lower end of steering shaft 58. Jack shaft 44 and steering shaft 58 are suitably connected together for rotation together such as by an endless flaccid member in the preferred form of a roller chain 62 extending around and between sprockets 60 and 48. In the most preferred form, chassis 12 includes a chain track 64 extending between the upper edges of walls 18 and 20. In the most preferred form, first and second idler sprockets 66 and 68 are located on the opposite sides of jack shaft 44 and on the opposite side of jack shaft 44 than steering shaft 58. Roller chain 62 extends from sprocket 60 to sprocket 66, then to sprocket 68, then to sprocket 48 and back to sprocket 60. As roller chain 62 extends around sprocket 48 intermediate the axes of sprockets 48 and 66, the rotational direction of jack shaft 44 will be opposite to that of steering shaft 58. It of course can be appreciated that this rotational direction change can be accomplished at other locations and/or by other manners. Specifically, the reversing action of sprockets 66 and 68 could be provided at steering shaft 58 or at spindle 38, with the location of the preferred form being for space considerations. It can then be appreciated that lower steering shaft 58 is rotatably connected to wheels 15 by sprockets 48, 60, 66, and 68, roller chain 62, jack shaft 44, sprockets 42, 46, and 52, roller chain 50, and spindle 38.

The steering system of machine 10 according to the preferred teachings of the present invention further includes a U-shaped steering column 70 having its lower, free ends pivotably connected to the upper free ends of vertical plates 54 about a generally horizontal axis extending perpendicular to shaft 58 and the movement direction of machine 10 and laterally of chassis 12. Suitable provisions can be provided to lock steering column 70 in one of a plurality of pivotable positions relative to plates 54. In the most preferred form, a plurality of apertures 72 are provided in one of the legs of steering column 70 and generally along an arc around the axis of steering column 70. A slide pin 74 is mounted to the corresponding plate 54 for removable insertion into one of apertures 72. Thus, when slide pin 74 is removed from apertures 72, steering column 70 can be pivoted relative to plates 54 of chassis 12. However, when slide pin 74 is slid into one of apertures 72, relative movement between steering column 70 and plates 54 of chassis 12 is prevented, with steering column 70 being held in the pivotable position corresponding to the particular aperture 72 in which slide pin 74 is provided.

An upper steering shaft 76 is rotatably mounted to the central portion of steering column 70. Suitable provisions are provided to connect shafts 58 and 76 for rotation together while allowing relative pivotable movement therebetween. In the most preferred form, a universal joint 78 is provided between the lower end of upper steering shaft 76 and the upper end of lower steering shaft 58. Suitable provisions such as a steering wheel 80 are secured to steering shaft 76 to allow the manual rotation of steering shaft 76 and thus of spindle 38 by the operator of machine 10.

In the preferred form, an operator seat 82 is provided on chassis 12 above drive wheels 14 and the battery compartment. It should then be appreciated that the tiltable steering system is advantageous for several reasons. Specifically, the physical size of operators vary. Thus, steering column 70 can be locked at the desired pivotable position so that steering wheel 80 is located at a desired spacing from seat 82 according to the comfort and tastes of the particular operator. Additionally, when it is desired for the operator to mount or dismount machine 10, steering column 70 can be pivoted away from seat 82 to provide added space while the operator sits down on or gets up from seat 82. This is especially advantageous for elderly or physically handicapped operators.

The steering system according to the preferred teachings of the present invention is also advantageous for other reasons. First, the steering system allows the rear steering of machine 10 by wheels 15 while utilizing only mechanical components and roller chains and specifically without the use of hydraulic components. Additionally, the steering system allows connection between the front steering components and the rear wheel components above the battery component and specifically without interference therewith. Additionally, the use of spindle 38 and a separate jack shaft 44 of the most preferred form allows the axial length of spindle 38 to be shorter allowing it to be structurally larger for strength purposes without significantly increasing the overall costs. Additionally, gear reductions can be provided between shafts 44 and 58 as well as between shaft 44 and spindle 38 to reduce the steering force required on steering wheel 80 by the operator.

Floor polishing machine 10 further includes suitable apparatus for raising polishing member 16 relative to the floor to allow transporting machine 10 from one location to another in a non-operating mode and for lowering polishing member 16 relative to the floor to allow engagement of polishing member 16 in an operating mode. Further, floor polishing machine 10 can include provisions for allowing the placement of even cleaning pressure on the floor surface by polishing member 16 regardless of the unevenness of the floor surface.

In particular, polishing member 16 is rotatable inside of a shroud 84 which may include an outer protective housing and a suitable dust collection system such as but not limited to of the type disclosed in U.S. Pat. Nos. 4,731,956, 5,088,151 or 5,974,626, which are hereby incorporated herein by reference. Polishing member 16 is rotated inside of shroud 84 by any suitable means such as by an electric motor 86 mounted to shroud 84, with polishing member 16 being driven directly or in a stepped up manner such as through a sheave and V-belt drive. Shroud 84 includes first and second brackets 88 and 90 upstanding therefrom.

For mounting shroud 84 and thus polishing member 16 to chassis 12 for movement relative to the floor surface, a main linkage 92 is provided of a generally U-shape including first and second legs 94 and 95 extending forward from a pivot rod or central portion 96. Linkage 92 is pivotably mounted to platform 36 of chassis 12 by screws 98 extending through bushings in chassis flanges and threaded into central portion 96 and defining a generally horizontal axis generally parallel to central portion 96. The free ends of legs 94 and 95 are pivotably mounted to brackets 88 and 90, respectively, by screws 100 extending through bushings in legs 94 and 95 and threaded into brackets 88 and 90. Screws 100 define a pivot axis which is parallel to and spaced from the axis defined by screws 98. Thus, shroud 84 is attached to chassis 12 in a manner so that shroud 84 is constrained in movement.

A first end of an adjustable length link or a turnbuckle 102 is pivotably mounted through a bushing to a chassis flange and its second end is pivotably mounted through a bushing to bracket 90 about axes which are parallel and spaced from each other and from the axes defined by screws 98 and 100. In the preferred form, chassis 12 between the first end of turnbuckle 102 and the axis defined by screw 98, bracket 90, leg 95, and turnbuckle 102 create a four bar linkage. Thus, the angle of shroud 84 from the front to the back is constrained by the design of the four bar linkage pivot points. In the preferred form, the pivot points are designed so that polishing member 16 is generally horizontal and parallel to the floor surface when positioned adjacent to the floor surface and tilts at an upward angle for ease of access when raised from the floor surface. It should then be appreciated that by adjusting the length between the first and second ends of turnbuckle 102, shroud 84 and thus polishing member 16 can be adjusted to be generally in a parallel plane to the floor surface desired to be polished when polishing member 16 is adjacent the floor surface.

In the most preferred form, linkage 92 is pivoted utilizing a linear actuator 104 which is pivotably mounted to a chassis flange about an axis which is spaced from and parallel to the axes defined by screws 98 and 100. Generally, actuator 104 includes a rotatable threaded shaft 106 upon which a nut 108 is threadably received. Thus, rotational movement of shaft 106 is converted to a linear motion via nut 108. A tubular spring housing 110 is provided of a size for slideable receipt of shaft 106 and nut 108. A spring 114 is positioned on shaft 106 and inside of housing 110, with the end of housing 110 opposite to actuator 104 being annular of a size allowing passage of shaft 106 but preventing passage of spring 114. Housing 110 includes elongated axial slots 112 on diametric opposite sides. A generally U-shaped nut retainer 116 (which in the preferred form is formed of two pieces removably secured together) is provided including radially extending, diametrically opposite pins which extend through slots 112 and are received in radial apertures on diametrically opposite sides of nut 108. When nut retainer 116 is in place, spring 114 is sandwiched between nut 108 and the end of housing 110 and biases housing 110 to slide on nut 108 away from nut 108 until the pins of retainer 116 abut with the ends of slots 112. It should then be appreciated that although housing 110 is restrained on nut 108, housing 110 is allowed to axially move or slide a distance equal to the length of slots 112 relative to nut 108 and parallel to shaft 106.

In the preferred form, leg 94 includes an upstanding tab 118, with leg 94 and tab 118 being generally L-shaped. Housing 110 is pivotably mounted to the free end of tab 118. In the preferred form, a mount 120 is removably secured to tab 118. The free ends of tab 118 and mount 120 include pins which extend into radially extending, diametrically opposite openings formed in housing 110 and defining a pivot axis parallel to and spaced from the axes defined by screws 98 and 100.

In the preferred form, leg 95 includes an upstanding tab 122, with leg 95 and tab 122 being generally L-shaped. A first end of a gas cylinder or spring 124 is pivotably mounted to tab 122 and its second end is pivotably mounted to bracket 90 about axes which are parallel and spaced from each other and from the axes defined by screws 98 and 100. It should then be appreciated that gas spring 124 biases linkage 92 to pivot about the axis defined by screws 98 with the free ends of legs 94 and 95 moving away from the floor surface to be polished.

As floor surfaces are never nearly flat, but rather have slight dips and high spots, it is necessary to allow the burnishing head to "float", that is to follow the floor surface as it rises and dips. This floating feature is accomplished through the attachment point of electrical actuator 104 to tab 118 of linkage 92. The biased, slideable attachment of housing 110 to nut 108 and thus of linear actuator 104 to linkage 92, and thereby the burnishing head, is therefore not a solid attachment, but one that works through spring 114 to allow a certain amount of floating travel. The burnishing head, which contains motor 86, shroud 84 and burnishing member 16, weighs an appreciable amount. In order to fully accommodate the floating requirement of the burnishing head for the optimum design, some of the weight of the burnishing head is offset, so that a lighter, lower spring-rate compression spring 114 may be utilized. In the preferred form, this assist is in the form of compressed gas cylinder 124. Gas cylinder 124 is sized to counterbalance approximately 80% of the weight of the burnishing head, so that electric actuator 104 and compression spring 114 have relatively little mass force on them, which provides for better floating of the burnishing head over uneven floors.

In the most preferred form, floor polishing machine 10 further includes an electronic control system 140 for controlling the pressure that polishing member 16 applies to the floor surface. In particular, system 140 includes a microcontroller 142 which controls the motor of actuator 104 and specifically the rotation of threaded shaft 106 of actuator 104. Specifically, the primary function of microcontroller 142 is to monitor the current level of motor 86 which drives polishing member 16 and to adjust the position of the burnishing head to maintain the current level within a desired range, with the position of the burnishing head relative to the floor surface affecting the pressure which polishing member 16 engages the floor surface and thus the current of motor 86 driving polishing member 16. In the most preferred form, the desired range can be adjusted by the operator depending upon operating conditions and within preset limits. In the preferred form, the position of the burnishing head is adjusted by rotating threaded shaft 106 of actuator 104. Particularly, if the current to motor 86 is above a desired range, microcontroller 142 actuates actuator 104 to rotate threaded shaft 106 to move the burnishing head away from the floor surface. On the other hand, if the current to motor 86 is below a desired range, microcontroller 142 actuates actuator 104 to rotate threaded shaft 106 to move the burnishing head towards the floor surface. If the current level to motor 86 as monitored by microcontroller 142 is within the desired range, microcontroller 142 does not actuate actuator 104 so that threaded shaft 106 does not rotate. If the current level to motor 86 as monitored by microcontroller 142 is above a safe level, microcontroller 142 will deactivate motor 86 to provide over current protection.

In the preferred form, the current to motor 86 is monitored by microcontroller 142 by measuring the voltage drop across a shunt. In the most preferred form, the shunt is formed by a cable 144 which makes up the negative supply lead to motor 86. In particular, cable 144 is cut to a specific length such as five feet (1.50 meters) of size 2 American Wire Gauge (AWG) wire and the cable connections are selected and are soldered to cable 144 to minimize any variance in the overall resistance of cable 144. A voltage monitoring lead 146 extends from microcontroller 142 to the cable connection of cable 144 at motor 86 for monitoring the voltage at that end. The voltage at the other cable connection of cable 144 can be monitored by microcontroller 142 because they are at a common point, but a monitoring lead can also be provided at that end. The difference between the voltages at the two cable connections of cable 144 then represents the voltage drop. In this regard, as the resistance of cable 144 will vary with temperature, a thermistor 148 is attached to cable 144 to measure the temperature of cable 144 and which is monitored by microcontroller 142 through monitoring lead 150. Thus, microcontroller 142 can calculate the voltage drop across cable 144 by subtracting the voltage at the common end of cable 144 from the motor end of cable 144, with suitable adjustments being made dependent on the temperature of cable 144 as measured by thermistor 148. It can be appreciated that there will be minor variations from cable 144 of one machine 10 to cable 144 of another machine 10, but these variations are well within the acceptable limits of accuracy for this application.

The use of shunts to measure current through an electrical device is well known. Conventionally, a shunt of a known resistance is placed in series with the electric device. The use of cable 144 as a shunt according to the preferred teachings of the present invention is believed to be unique and results in several advantages. First, the expense of purchasing or fabricating and of assembling a separate shunt is eliminated. Additionally, the heat generated by current passing through cable 144 is spread out over a much larger area due to the elongated length of cable 144 in comparison to the area of a separate conventional shunt. Thus, the maximum temperature rise of cable 144 (which varies the resistance) is reduced.

When it is desired to store machine 10, during transit between surfaces desired to be treated, and during maintenance or replacement of member 16, actuator 104 holds the burnishing head above the floor. When machine 10 according to the preferred teachings of the present invention begins operation, the operator depresses a down/on switch on the control panel, which operates actuator 104 to lower the burnishing head to the floor. Actuator 104 is controlled through electronic control system 140, which stops the burnishing head a small distance from the floor. When motor 86 starts, the centrifugal force of burnishing member 16 rotating in close proximity to the floor creates a vacuum under member 16, causing it to suck down to the floor, compressing compression spring 114. Electronic control systems 140 begins monitoring the electrical current of motor 86, and pulses actuator 104 either in the raised direction if the current is higher than the preset current range, or in the lowered direction if the current is lower than the range. As spring 114 provides for a certain amount of head float as machine 10 travels over the floor, the motor current does not change drastically as dips and high spots are encountered, resulting in relatively infrequent actuator adjustment. Additionally, in the most preferred form, microcontroller 142 (after initially reaching the preset current range) averages the current readings through motor 86 over a one minute period and activates actuator 104 at the end of the one minute period if the average current reading is outside of the preset current range.

Machine 10 in the most preferred form is battery powered and includes a plurality of batteries 126 for providing power to motor 86, actuator 104, the drive motor for wheels 14 and any other drives or electrical components of machine 10. In the preferred form shown, batteries 126 are positioned in a battery box 128 of a right parallelepiped shape having an open top. Battery box 128 may include a battery liner or tray. The front and back faces of battery box 128 include a generally U-shaped slide 130. In the form shown, each slide 130 includes a central portion 132 suitably secured to the face of battery box 128 such as by welding. Slide 130 further includes an upper lip 134 integrally extending generally perpendicular from the upper edge of central portion 132 and the face of battery box 128. Slide 130 also includes a lower flange 136 integrally extending at an obtuse angle from the lower edge of central portion 132 and the face of battery box 128. In particular, the angle of flanges 136 corresponds to and is for slideably receipt in flanges 26 of walls 18 and 20.

It should be appreciated that due to the interlock of slides 130 with flanges 26 which are located on the lower edges of walls 18 and 20, the bottom of battery box 128 and thus of batteries 126 are located as low as possible in chassis 12 and as close as practically possible to the floor surface. In particular, the bottom of battery box 128 and of batteries 126 are located at a position intermediate wheels 14 and 15 and below a horizontal plane extending through either of the axes of wheels 14 and 15 or of a plane intersecting both of the axes of wheels 14 and 15. In the preferred form, the bottom of battery box 128 is generally in a parallel relation to the surface and with the floor surface defines a space between the surface and the bottom of battery box 128 which is free of obstruction. In particular, the burnishing head, other devices providing a function on the surface, or control components including mechanical and/or electric linkages such as but not limited to for the steering system are not positioned vertically below the bottom of battery box 128 or are not positioned outwardly of the longitudinal sides of battery box 128 but rather are positioned to the front, rear, or above the battery compartment. Additionally, the weight of the battery pack forms a substantial portion of machine 10 and in the preferred form represents about 75% of the total weight of machine 10, with the battery pack weighing approximately 800 pounds (365 kilograms) in the most preferred form. It should then be appreciated that positioning batteries 126 as low as possible lowers the center of gravity and thereby increases the stability of machine 10 according to the preferred teachings of the present invention.

In the most preferred form, batteries 126 and battery box 128 define an interchangeable battery pack so that while one battery pack is being utilized in machine 10, one or more battery packs can be at a charging location. In this regard, suitable conventional electrical connectors can be provided between batteries 126 and the wiring harness of machine 10. When it is desired to replace the battery pack, the operator would first electrically disconnect batteries 126 from the rest of machine 10, with the operator obtaining access to the electrical connectors by tilting seat 82 in the most preferred form. Door 32 can then be opened to provide access to the battery pack.

Due to the substantial mass of the battery pack, battery box 128 is of a size and shape for lifting by a standard pallet jack in the most preferred form. Particularly, in the most preferred form, the fork of the pallet jack is placed under the bottom of battery box 128, and the fork is raised to raise battery box 128 from a lowered position to a raised position. In the raised position, flanges 136 are located above flanges 26 and projections 30, with the abutment of lips 134 with tabs 34 acting as a stop to prevent further vertical movement of the battery pack relative to the remaining portions of machine 10. It can then be appreciated that the vertical extent between projections 30 and tabs 34 is slightly greater than the vertical extent between lip 134 and flange 136.

Once slide 130 is located above projections 30 and with the bottom of battery box 128 being supported by the fork of the pallet jack, the pallet jack can be moved horizontally to move the battery pack in a horizontal movement direction generally parallel to slides 130 and flanges 26 and out of the battery compartment of machine 10. After its removal, the battery pack can be moved to a location where batteries 126 can be charged in a conventional manner.

While one battery pack is being charged, another battery pack can be inserted into the battery compartment by simply reversing the removal procedure. In addition to the abutment with tabs 34, lips 134 assist in the centering of the battery pack between walls 18 and 20 during insertion (and removal). After the battery pack is lowered to its lowered position such that flanges 136 engage flanges 26, continual lowering of the fork of the pallet jack will space the fork below the bottom of battery box 128 so that the pallet jack can be easily removed. Once supported by the abutment of flanges 136 on flanges 26, lateral movement of battery box 128 in the horizontal movement direction is stopped by the abutment of the inner ends of slides 130 and the inner side face of battery box 128 with side wall 22 and by the abutment of the outer ends of slides 130 with projections 30 of side wall 24.

An advantage of the complementary angling of flanges 26 and 136 is that a camming action occurs therebetween. The relatively large mass of batteries 126 acting through the camming interlocks provided between flanges 26 and 136 prevents the movement of the lower edges of walls 18 and 20 relative to each other. Thus, the preferred form of chassis 12, the battery pack, the camming interlock therebetween, and the relatively large battery mass provide added strength and structural rigidity to chassis 12 during operation. Thus, the preferred construction of machine 10 according to the teachings of the present invention allows chassis 12 to be more compact resulting in greater maneuverability of machine 10. In particular, battery box 128 and batteries 126 have a longitudinal dimension which is generally equal to but slightly less than the longitudinal distance of the spacing between wheels 14 and 15 and have a lateral dimension which is generally equal to but slightly less than the lateral distance between side walls 22 and 24, and specifically there is no function or control components located between the front and rear faces of battery box 128 and wheels 14 and 15 or between the side faces of battery box 128 and side walls 22 and 24. Thus, in the most preferred form, side walls 22 and 24 of chassis 12 are formed by a single thickness plate. Although having reduced structural strength with the battery pack removed, machine 10 would not be operational and would not be subject to the stress resulting from operation or transport of machine 10.

An advantage of having door 32 hinged to side wall 24 rather than attached to battery box 128 is that battery box 128 and batteries 126 therein can be inserted with either of the side faces being inserted into the battery compartment. Likewise, although side wall 22 could also include an opening 28 and door 32 to allow insertion and removal of the battery pack from either side of machine 10, machine 10 in the most preferred form includes opening 28 only in wall 24 for cost reduction reasons.

It should then be appreciated that the battery pack of machine 10 according to the most preferred embodiment can be interchanged with a recharged battery pack in a matter of minutes. Thus, machine 10 of the most preferred form can be operated for extended periods in a very similar manner as prior internal combustion powered machines, but without the safety hazards resulting from hazardous emissions. Therefore, machine 10 according to the preferred teachings of the present invention is able to additionally penetrate the market which was previously only open to propane machines. In addition, as the operator sits on seat 82 and rides on machine 10, machine 10 according to the most preferred form can travel faster than a walk-behind propane machine, the operator will not tire during extended operating periods, and machine 10 can be operated by operators who for various physical limitations were unable to operate prior burnishing machines especially for extended periods.

Now that the basic teachings of the present invention have been explained, many extensions and variations will be obvious to one having ordinary skill in the art. For example, although machine 10 has been shown and described according to the preferred teachings of the present invention including multiple features which are believed to be synergistically advantageous, apparatus for treating surfaces can be provided according to the teachings of the present invention including one or more of such features and in other combinations. As a single example, the floating burnishing head aspects of the preferred form could be utilized in propane or cord powered machines or battery powered machines which do not have the interchangeable battery pack aspects of the present invention.

Similarly, although machine 10 in the preferred form is shown and explained as especially adapted for the burnishing of floor surfaces, features according to the teachings of the present invention would be useful in machines 10 for treating surfaces in other applications.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. Apparatus for treating a surface comprising, in combination: a chassis adapted to be moved along the surface; means mounted to the chassis for treating the surface as the chassis is moved along the surface; a plurality of batteries for providing power to the surface treating means; a battery box for holding the plurality of batteries and including a bottom; and means for removably mounting the battery box in the chassis allowing the battery box to be removed from and inserted into the chassis in a horizontal movement direction comprising, in combination: first and second slides secured to the battery box, and first and second flanges secured to the chassis for receipt of the first and second slides of the battery box; wherein the first and second flanges extend upwardly and inwardly at an acute angle; and wherein the first and second slides include flange portions extending at an obtuse angle corresponding to and for slideable receipt in the first and second flanges resulting in a camming action between the flange portions and the first and second flanges interlocking the battery box and the chassis.

2. Apparatus for treating a surface comprising, in combination: a chassis adapted to be moved along the surface; means mounted to the chassis for treating the surface as the chassis is moved along the surface; a plurality of batteries for providing power to the surface treating means; a battery box for holding the plurality of batteries including a bottom; and means for removably mounting the battery box in the chassis allowing the battery box to be removed from and inserted into the chassis in a horizontal movement direction comprising, in combination: first and second slides secured to the battery box, first and second flanges secured to the chassis for receipt of the first and second slides of the battery box, and first and second tabs formed in the chassis spaced vertically above the first and second flanges, with the first and second slides having an extent which is less than the spacing between the first and second tabs and the first and second flanges.

3. Apparatus for treating a surface comprising, in combination: a chassis adapted to be moved along the surface; means for steering the chassis on the surface; means mounted to the chassis for treating the surface as the chassis is moved along the surface; a plurality of batteries for providing power to the surface treating means; a battery box for holding the plurality of batteries and including a bottom; and means for removably mounting the battery box in the chassis allowing the battery box to be removed from and inserted into the chassis in a horizontal movement direction and while supported by the bottom; wherein the removably mounting means allows the battery box to be moved between a lowered position and a raised position spaced vertically above the lowered position, with the battery box being prevented from moving in the horizontal movement direction in the lowered position and being allowed to move in the horizontal movement direction in the raised position.

4. The surface treating apparatus of claim 3 wherein the removably mounting means comprises, in combination: first and second slides secured to the battery box; and first and second flanges secured to the chassis for receipt of the first and second slides of the battery box.

5. The surface treating apparatus of claim 3 wherein the chassis includes a battery compartment formed and defined by spaced first and second walls having lower edges, with the battery compartment having a bottom defined by the lower edges of the first and second walls; wherein the removably mounting means interlocks the battery box to the first and second walls for preventing movement of the lower edges of the first and second walls relative to each other to provide added strength and structural rigidity to the chassis during operation of the surface treating apparatus.

6. The surface treating apparatus of claim 5 wherein the chassis is moved along the surface in a forward movement direction when the surface is being treated; and wherein the first and second walls extend generally perpendicular to the forward movement direction.

7. The surface treating apparatus of claim 5 wherein the chassis is adapted to be moved along the surface by at least a first front wheel and at least a first rear wheel, with the front wheel located forward of the first wall in the forward movement direction and the rear wheel located rearwardly of the second wall in the forward movement direction, with the battery box mounted in the chassis located between the front and rear wheels, with the removably mounting means allowing the battery box to be removed from and inserted into the chassis by movement intermediate the front and rear wheels in a horizontal movement direction.

8. The surface treating apparatus of claim 3 wherein the chassis has a front and a rear and includes front wheels mounted adjacent to the front of the chassis and at least one steerable rear wheel mounted adjacent the rear of the chassis, and wherein the steering means comprises, in combination: a pillar upstanding adjacent to the front of the chassis; a lower steering shaft rotatably mounted to the pillar about an axis; a steering column pivotably connected to the pillar about an axis; an upper steering shaft rotatably mounted to the steering column about an axis; means for connecting the lower and upper steering shafts for rotation together while allowing relative pivotable movement therebetween; means for allowing manual rotation of the upper steering shaft; and means for rotatably connecting the lower steering shaft to the steerable rear wheels.

9. The surface treating apparatus of claim 3 further comprising, in combination: means for mounting the treating means to the chassis for movement relative to the surface comprising, in combination: a linkage pivotably mounted to the chassis about a first axis and pivotably mounted to the treating means about a second axis spaced from and parallel to the first axis; an actuator pivotably mounted to the chassis about a third axis spaced from and parallel to the first axis, with the actuator including a rotatable threaded shaft and a nut threadably received on the threaded shaft; a housing pivotably mounted to the linkage about a fourth axis spaced from and parallel to the first and third axes, with the housing being restrained on the nut while allowing relative axial movement for a distance parallel to the threaded shaft; and means for biasing the housing away from the nut.

10. The surface treating apparatus of claim 3 wherein the surface treating means is rotatable by an electric motor; and wherein the surface treating apparatus further comprises, in combination: means for movably mounting the surface treating means for movement toward and away from the surface, means for moving the movably mounting means, means for monitoring the current level of the electric motor, and means for controlling the moving means in response to the monitored current level of the electric motor for moving the movably mounting means and the surface treating means so that the surface treating means engages the surface with a force so that the current level of the electric motor is within a predetermined range.

11. The surface treating apparatus of claim 3 wherein the bottom is generally in a parallel relation to the surface and defining a space between the surface and the bottom which is free of obstruction.

12. Apparatus for treating a surface comprising, in combination: a chassis adapted to be moved along the surface; means mounted to the chassis for treating the surface as the chassis is moved along the surface; a plurality of batteries for providing power to the surface treating means; a battery box for holding the plurality of batteries and including a bottom; and means for removably mounting the battery box in the chassis allowing the battery box to be removed from and inserted into the chassis in a horizontal movement direction comprising, in combination: first and second slides secured to the battery box, first and second flanges secured to the chassis for receipt of the first and second slides of the battery box, and first and second projections formed in the chassis having an extent generally equal to the extent of the first and second flanges and adapted to abut with the ends of the slides.

13. The surface treating apparatus of claim 12 wherein the first and second flanges extend upwardly and inwardly at an acute angle; and wherein the first and second slides include flange portions extending at an obtuse angle corresponding to and for slideable receipt in the first and second flanges.

14. Apparatus for treating a surface comprising, in combination: a chassis adapted to be moved along the surface; means mounted to the chassis for treating the surface as the chassis is moved along the surface; a plurality of batteries for providing power to the surface treating means; and a battery box for holding the plurality of batteries and including a bottom, with the battery box being mounted in the chassis as low as possible with the bottom of the battery box defining a space with the surface which is free of obstruction; wherein the chassis includes front and rear wheels, with the chassis being movable on the surface by the front and rear wheels, with the battery box mounted in the chassis between the front and rear wheels; and wherein the battery box is removably mounted in the chassis allowing the battery box to be removed from and inserted into the chassis in a horizontal movement direction entirely between and below a portion of each of the front and rear wheels.

15. The surface treating apparatus of claim 14 wherein the front and rear wheels are rotatable about horizontal axes, with the bottom of the battery box located below a plane extending through the axes of the front and rear wheels.

16. The surface treating apparatus of claim 14 wherein the battery box is removably mounted in the chassis allowing the battery box to be removed from and inserted into the chassis in a horizontal movement direction intermediate the front and rear wheels and while supported by the bottom.

17. The surface treating apparatus of claim 14 wherein the front and rear wheels are spaced a longitudinal distance; and wherein the battery box has a longitudinal dimension which is generally equal to but slightly less than the longitudinal distance.

18. The surface treating apparatus of claim 14 wherein the battery box is removably mounted in the chassis in a manner where the battery box is removed from and inserted into the chassis by a removal force applied to and supporting the bottom of the battery box.

* * * * *